US010668345B2

(12) United States Patent
Goldwitz

(10) Patent No.: US 10,668,345 B2
(45) Date of Patent: Jun. 2, 2020

(54) HOCKEY TRAINING DEVICES

(71) Applicant: Brian Goldwitz, New Haven, CT (US)

(72) Inventor: Brian Goldwitz, New Haven, CT (US)

( * ) Notice: Subject to any disclaimer, the term of this patent is extended or adjusted under 35 U.S.C. 154(b) by 0 days.

(21) Appl. No.: 15/823,539

(22) Filed: Nov. 27, 2017

(65) Prior Publication Data

US 2018/0147466 A1 May 31, 2018

Related U.S. Application Data

(60) Provisional application No. 62/427,096, filed on Nov. 28, 2016.

(51) Int. Cl.

| | |
|---|---|
| ***A63B 69/00*** | (2006.01) |
| ***A63B 63/00*** | (2006.01) |
| *A63B 5/16* | (2006.01) |
| *A63B 24/00* | (2006.01) |

(52) U.S. Cl.

CPC ..... *A63B 69/0024* (2013.01); *A63B 63/004* (2013.01); *A63B 5/16* (2013.01); *A63B 24/0021* (2013.01); *A63B 69/0026* (2013.01); *A63B 2063/001* (2013.01); *A63B 2225/09* (2013.01)

(58) Field of Classification Search

CPC ..... A63B 69/0026; A63B 69/00; A63B 63/00; A63B 69/02; A63B 24/0021; A63B 69/0024; A63B 63/04; A63B 63/001; A63B 2225/09; A63B 5/16

USPC ..... 473/422, 434, 435, 446; D21/698, 699, D21/706, 722, 710

See application file for complete search history.

(56) References Cited

U.S. PATENT DOCUMENTS

| | | | | |
|---|---|---|---|---|
| 3,955,815 | A * | 5/1976 | Deschesnes | A63B 69/0026 473/446 |
| 4,607,842 | A * | 8/1986 | Daoust | A63B 24/0021 473/446 |
| 5,226,821 | A * | 7/1993 | Murphy | A63B 69/0026 434/247 |
| 5,351,960 | A * | 10/1994 | Knapp | A63B 57/405 473/182 |
| 5,362,045 | A * | 11/1994 | Hammett | A63B 69/0026 473/435 |
| 5,465,958 | A * | 11/1995 | Brun | A63B 69/0026 473/426 |
| 6,569,041 | B1 * | 5/2003 | Riivald | A63B 69/0026 473/423 |
| 7,104,901 | B1 * | 9/2006 | Mason | A63B 5/16 473/446 |
| D628,253 | S * | 11/2010 | McKinney | D21/722 |

(Continued)

*Primary Examiner* — Mitra Aryanpour

(74) *Attorney, Agent, or Firm* — Loza & Loza, LLP; Julio M. Loza; Tyler J. Barrett

(57) ABSTRACT

Hockey training devices generally include a frame, and a flexible band coupled to the frame. At least one spring may be coupled to at least one longitudinal end of the flexible band. A plurality of backstop structures may be coupled to the frame to extend substantially orthogonal to a top surface of the frame. A first rebounder wing may be coupled to a first side of the frame, and a second rebounder wing may be coupled to a second side of the frame. The first and second rebounder wings may each include a respective wing structure coupled to the frame, and a respective flexible band extending between a portion of the respective wing structure and either the frame or the first flexible band. Other aspects, embodiments, and features are also included.

7 Claims, 7 Drawing Sheets

(56) References Cited

U.S. PATENT DOCUMENTS

| | | | | |
|---|---|---|---|---|
| 8,469,841 | B1 * | 6/2013 | Giauque | A63B 69/0026 473/446 |
| 8,905,868 | B2 * | 12/2014 | Quinn | A63B 69/0026 473/446 |
| D798,400 | S * | 9/2017 | Klanow | D21/698 |
| 9,950,231 | B2 * | 4/2018 | Bulloch | A63B 69/0026 473/446 |
| 10,076,695 | B1 * | 9/2018 | Simon | A63B 69/0026 473/446 |
| 2005/0032580 | A1 * | 2/2005 | Rango | A63B 69/3676 473/164 |
| 2017/0232319 | A1 * | 8/2017 | Nelson | A63B 69/00 473/446 |

* cited by examiner

HOCKEY TRAINING DEVICES

PRIORITY CLAIM

The present application for patent claims priority to Provisional Application No. 62/427,096 entitled "Hockey Training Devices and Methods of Making Hockey Training Devices" and filed Nov. 28, 2016, the entire disclosure of which is expressly incorporated by reference into the present document as if fully disclosed herein.

TECHNICAL FIELD

The technology discussed below relates generally to sports training devices, and more specifically to hockey puck rebounders for rebounding a hockey puck or ball to a player when shot against.

BACKGROUND

Hockey training techniques and devices have been in use for years. Typically, it is required to have multiple players working together to practice passing and one-timer shots. For various reasons, however, it may not always be possible for multiple players to practice together. Because of the inherent problems with the related art, there is a need for a new and improved hockey rebounder for rebounding a hockey puck or ball to a player when the player shoots or passes the puck or ball against the device.

BRIEF SUMMARY OF SOME EXAMPLES

The following summarizes some aspects of the present disclosure to provide a basic understanding of the discussed technology. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in summary form as a prelude to the more detailed description that is presented later.

One or more aspects of the present disclosure include hockey training devices. According to at least one embodiment, a hockey training device may include a frame and two pulleys coupled to the frame. A flexible band may extend between the two pulleys and may be disposed around each of the pulleys. At least one spring may be coupled to at least one longitudinal end of the flexible band.

Additional embodiments of a hockey training device may include a frame and a flexible band coupled to the frame. A plurality of backstop structures may be coupled to the frame to extend substantially orthogonal to a top surface of the frame. A net may be coupled to the plurality of backstop structures.

Yet additional embodiments of a hockey training device may include a frame and a first flexible band coupled to the frame. A first rebounder wing may be coupled to a first side of the frame, where the first rebounder wing includes a first wing structure coupled to the frame, and a second flexible band extending between a portion of the first wing structure and either the frame or the first flexible band. A second rebounder wing may be coupled to a second side of the frame, where the second rebounder wing includes a second wing structure coupled to the frame, and a third flexible band extending between a portion of the second wing structure and either the frame or the first flexible band.

Other aspects, features, and embodiments associated with the present disclosure will become apparent to those of ordinary skill in the art upon reviewing the following description in conjunction with the accompanying figures.

DRAWINGS

DETAILED DESCRIPTION

The illustrations presented herein are, in some instances, not actual views of any particular training device, but are merely idealized representations which are employed to describe the aspects and features associated with the present disclosure. Additionally, elements common between figures may retain the same numerical designation.

Figure 1:
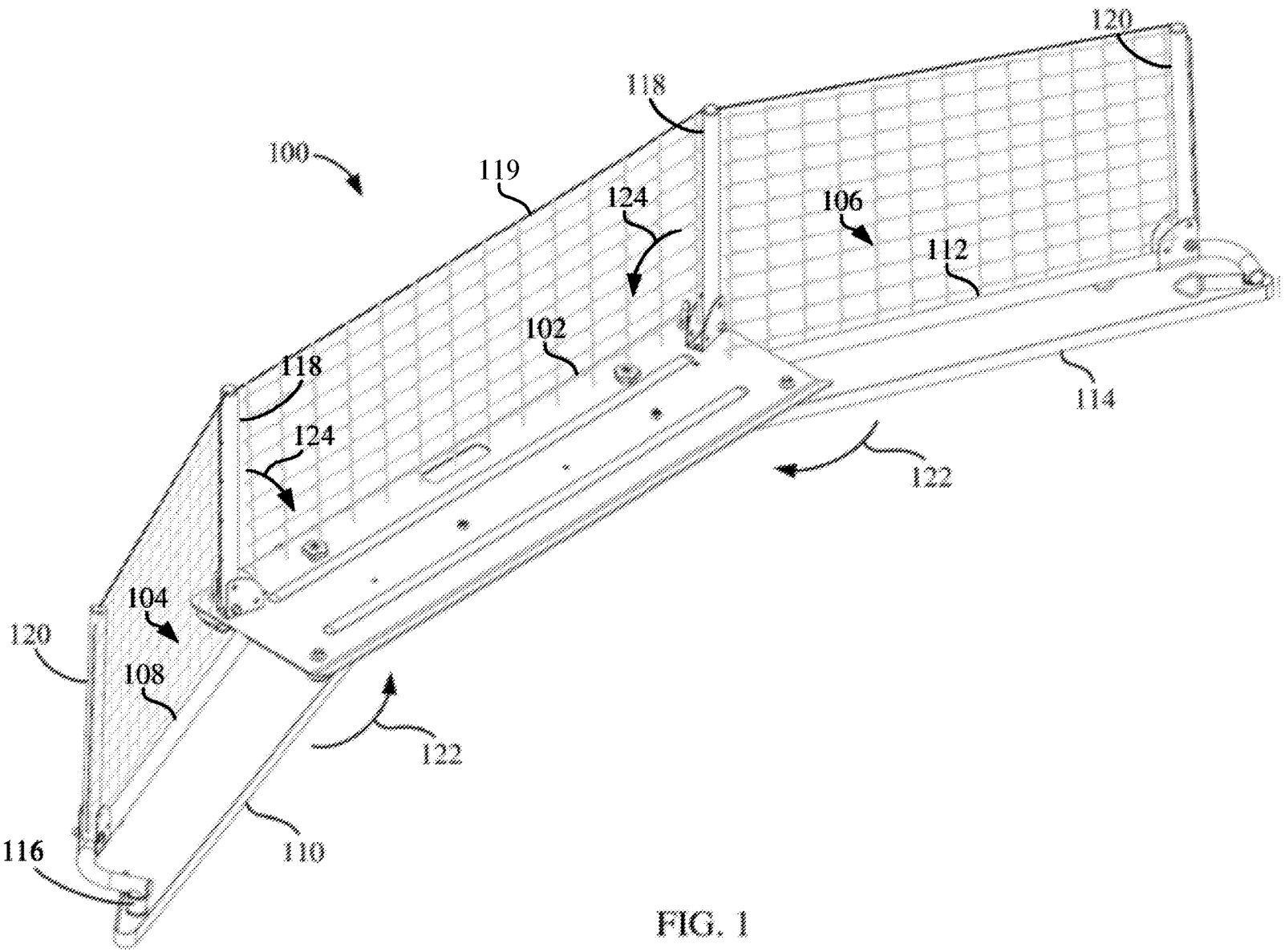
FIG. 1 is an isometric top view of a training device according to at least one embodiment.
Figure 2:
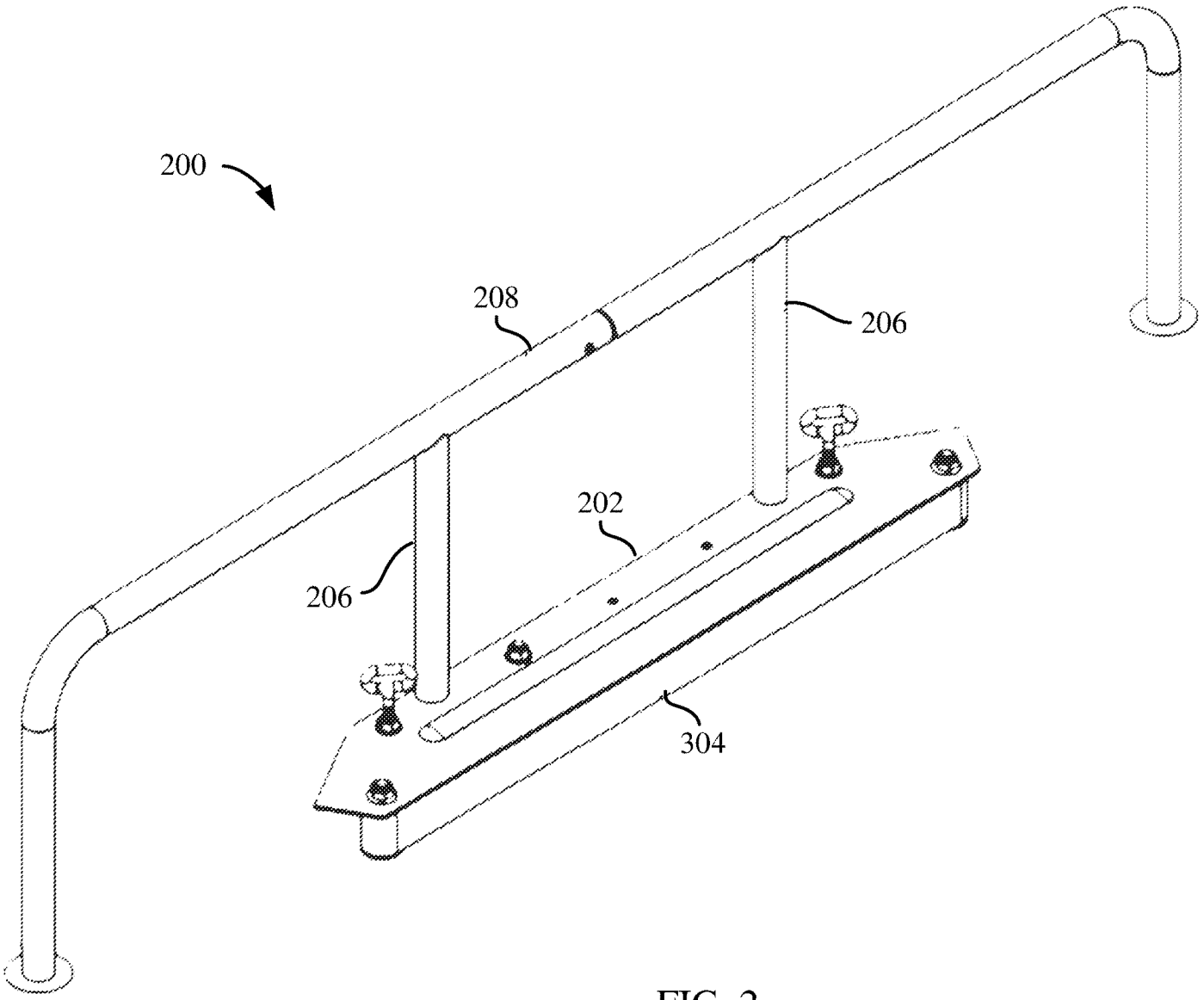
FIG. 2 is an isometric top view of a training device according to at least one embodiment.

FIG. 1 is an isometric view of a training device 100 according to at least one embodiment, and FIG. 2 is an isometric view of a training device 200 according to at least one other embodiment. Referring first to FIG. 1, the training device 100 includes a frame 102. Similarly, the training device 200 in FIG. 2 also includes a frame 202. The training device 100 and the training device 200 are both configured to rebound hockey pucks to a user when the hockey pucks are shot at the device.

Figure 3:
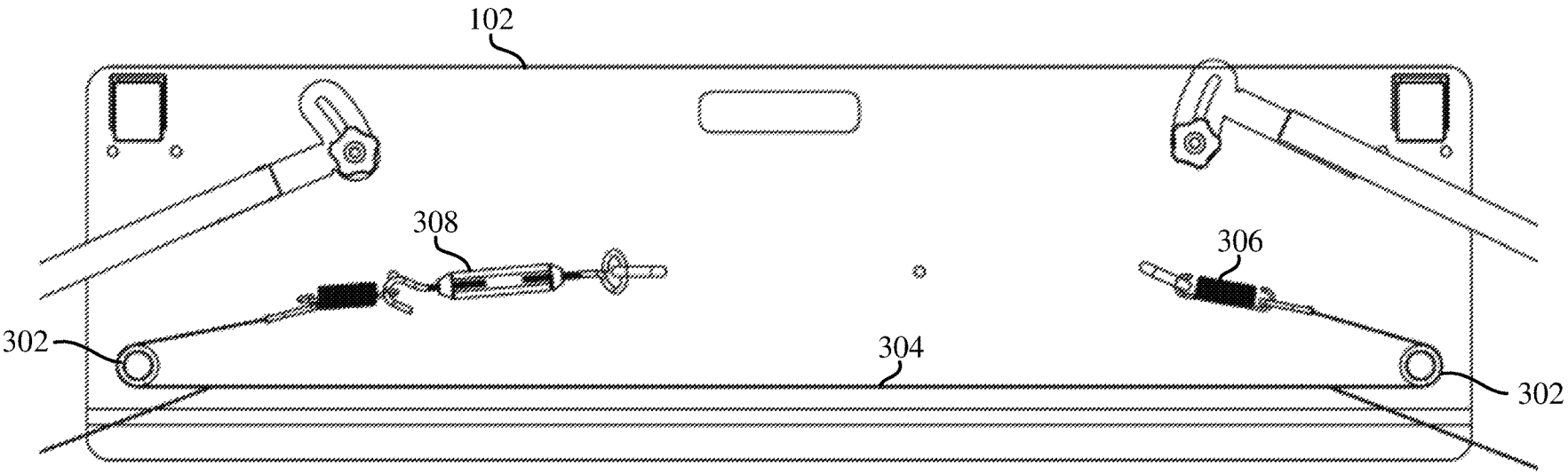
FIG. 3 is a view of the frame for the training device of FIG. 1 showing components located on an underside of the frame.

According to an aspect of the present disclosure, training devices 100/200 can include a flexible band coupled with the frame to rebound hockey pucks. For example, FIG. 3 is a view of the frame 102 for training device 100 showing components located on an underside of the frame 102. As shown, two pulleys 302 may be coupled to the frame 102, and a flexible band 304 is disposed around each pulley 302 and extends between the two pulleys 302. The flexible band 304 creates a bounce back surface when a puck hits against the flexible band 304.

According to various embodiments, at least one end of the band 304 can be coupled to a spring 306. The spring 306 aids in keeping tension on the band 304 to rebound a puck hit against the band 304. As shown in the example in FIG. 3, the spring 306 may be coupled to the frame 102 in some embodiments. Although the spring shown in the drawings is a conventional coiled spring, it will be apparent to those of skill in the art that the spring can be another spring-like component, including forming the band 304 from a flexible material. In some embodiments, a tensioner 308 component may also be employed. In the example in FIG. 3, the tensioner 308 can be coupled to the opposite longitudinal end of the band 304 and may be coupled to the frame 102. The tensioner 308 can be configured to shorten a distance between its two ends to facilitate tightening down the band 304, or increase the tension in the band 304 as desired.

Figure 4:
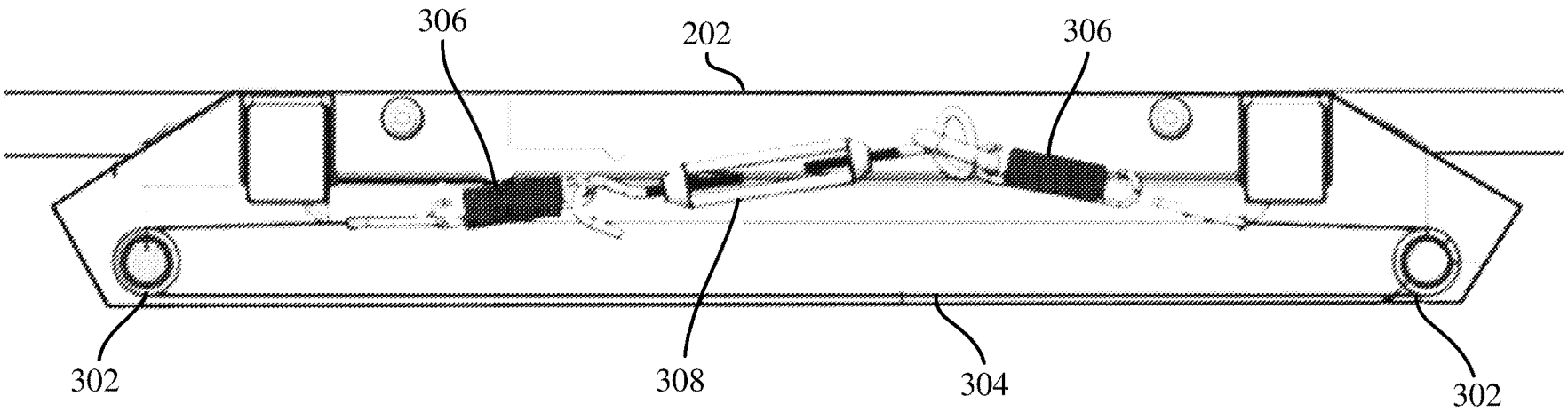
FIG. 4 is a bottom view of the frame for the training device of FIG. 2.

In some embodiments, a respective spring 306 may be couple to each longitudinal end of the band 304. For example, FIG. 4 is a bottom view of the frame 202 from FIG. 2. As depicted, the band 304 extends between two points 302, similar to the example in FIG. 3. In this example, a respective spring 306 is coupled to each longitudinal end of the band 304. In some embodiments, each spring 306 can be coupled to the frame 202. In the embodiment depicted, the two respective springs 306 are each coupled to a tensioner 308.

According to one or more embodiments, training devices 100/200 of the present disclosure might include rebounder wings coupled to either side of the frame 102/202. For example, the rebounder 100 in FIG. 1 includes a first rebounder wing 104 coupled to one side of the frame 102, and a second rebounder wing 106 coupled to the other side of the frame 102. The first rebounder wing 104 includes a first wing frame or structure 108 coupled to the frame 102 and a second flexible band 110. The second rebounder wing 106 likewise includes a second wing frame or structure 112 coupled to the frame 102 and a third flexible band 114.

Each of the rebounder wings 104, 106 can include a respective pulley coupled to the respective wing structure. For example, the first rebounder wing 104 includes a pulley 116 coupled to the first wing structure 108. The second band 110 is positioned around the pulley 116.

Figure 5:
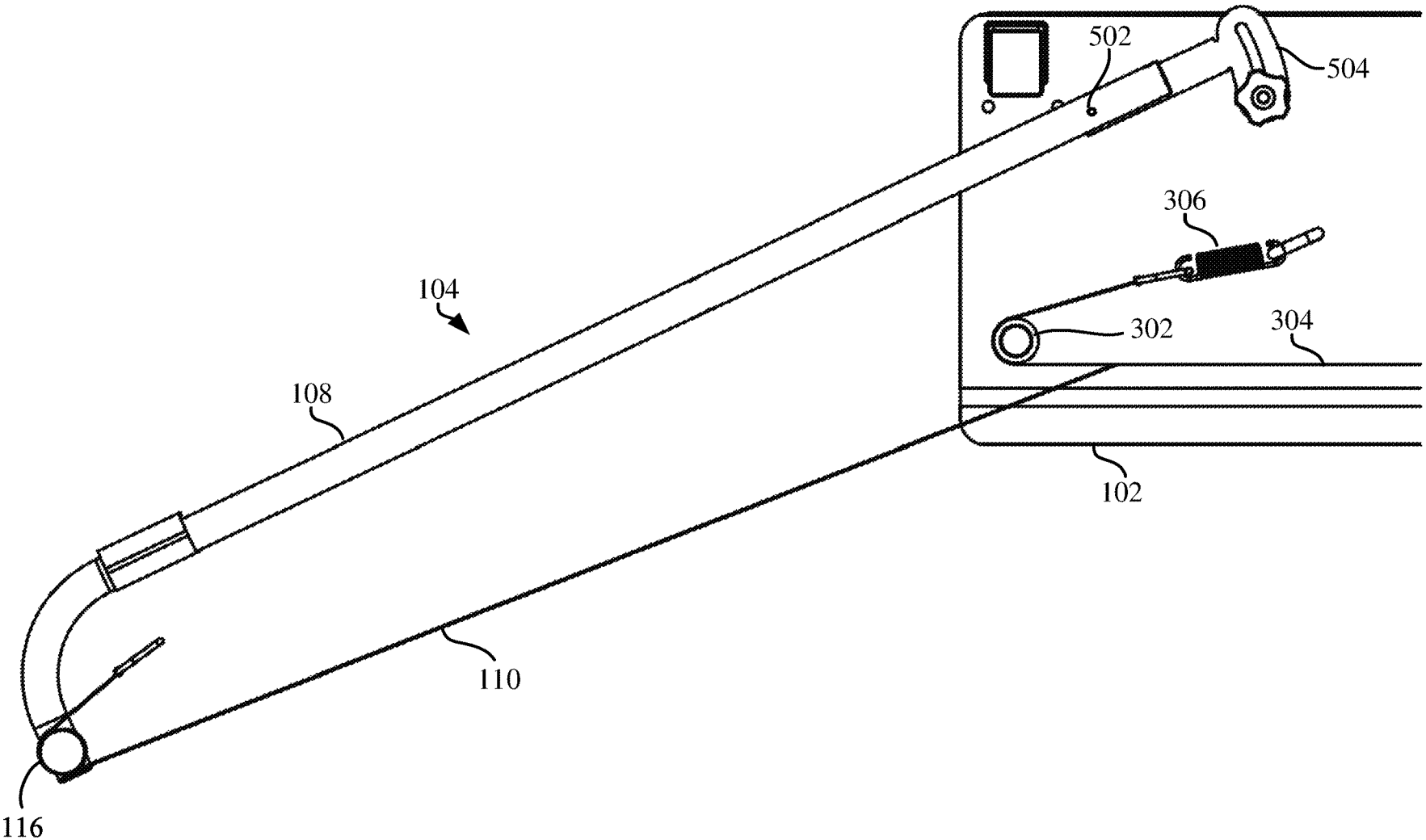
FIG. 5 is a top view of a rebounder wing according to at least one embodiment.

FIG. 5 is a bottom view of the first rebounder wing 104 in FIG. 1. As shown, the first wing structure 108 can be coupled to the frame 102 in a pivotable fashion. That is, the first wing structure 108 is coupled to the frame 102 in a manner to facilitate pivoting of the first wing structure 108 to different angles. In the depicted embodiment, the first wing structure 108 is coupled to the frame 102 with a rod 502 about which the first wing structure 108 can pivot. In this example, a stopper mechanism 504 is also include to limit the distance the rebounder wing 104 can rotate. The stopper mechanism 504 includes a slot with a bolt positioned within the slot. The first wing structure 108 can rotate the distance enabled by the size of the slot in the stopper mechanism 504.

Also depicted in FIG. 5 is an embodiment where the flexible band associated with the wing structures can be coupled to the flexible band 304. As shown, the second band 110 is coupled to the band 304. Such configuration can protect the pulley 302 from damage that may be caused by being hit by a puck. In other embodiments, however, the second band 110 can be coupled to a portion of the frame 102.

According to a further aspect of the present disclosure, training devices can include a backstop to stop errant pucks or balls. Referring to the example in FIG. 1, the training device 100 includes backstop structures 118. The backstop structures 118 can be formed from rods or pipes extending generally orthogonal to a top surface of the frame 102. A net 119 or other material can be coupled to, and extend between the backstop structures 118 to form a backstop that is configured to stop pucks or balls from passing behind the area of the backstop. In the embodiment depicted in FIG. 1, the rebounder wings 104, 106 can also include backstop structures 120, and a net 119 or other material can be coupled to, and extend between the backstop structures 120 and an adjacent backstop structure 118 to create a full backstop around the training device 100.

In other embodiments, a backstop may include a configuration that frames the net or other material. For example, the embodiment depicted in FIG. 2 includes backstop structures 206 extending generally orthogonal to a top surface of the frame 202, as well as a crossing structure 208 that is coupled to and extends between each of the backstop structures 206. The backstop structures 206 together with the crossing structure 208 can frame a net or other material (not shown) that may be coupled to the backstop structures 206 and to the crossing structure 208 to form a backstop capable of stopping pucks or balls from passing behind the area of the backstop.

According to a further aspect of the present disclosure, embodiments including rebounder wings 104, 106 and/or backstop structures 118, 120, 206 can be configured to fold relative to the frame 102, 202 to facilitate compact storage and transport of the training device 100, 200. For example, as depicted in FIG. 1, the rebounder wings 104, 106 may be movably coupled to the frame 102 to hinge toward the underside of the frame 102 in a general direction of the arrows 122. Further, the backstop structures 118 are coupled to the frame 102 to hinge toward the topside of the frame 102 in a general direction of the arrows 124. Similarly, the backstop structures 120 can also hinge down toward the respective rebounder wings 104, 106.

Figure 6:
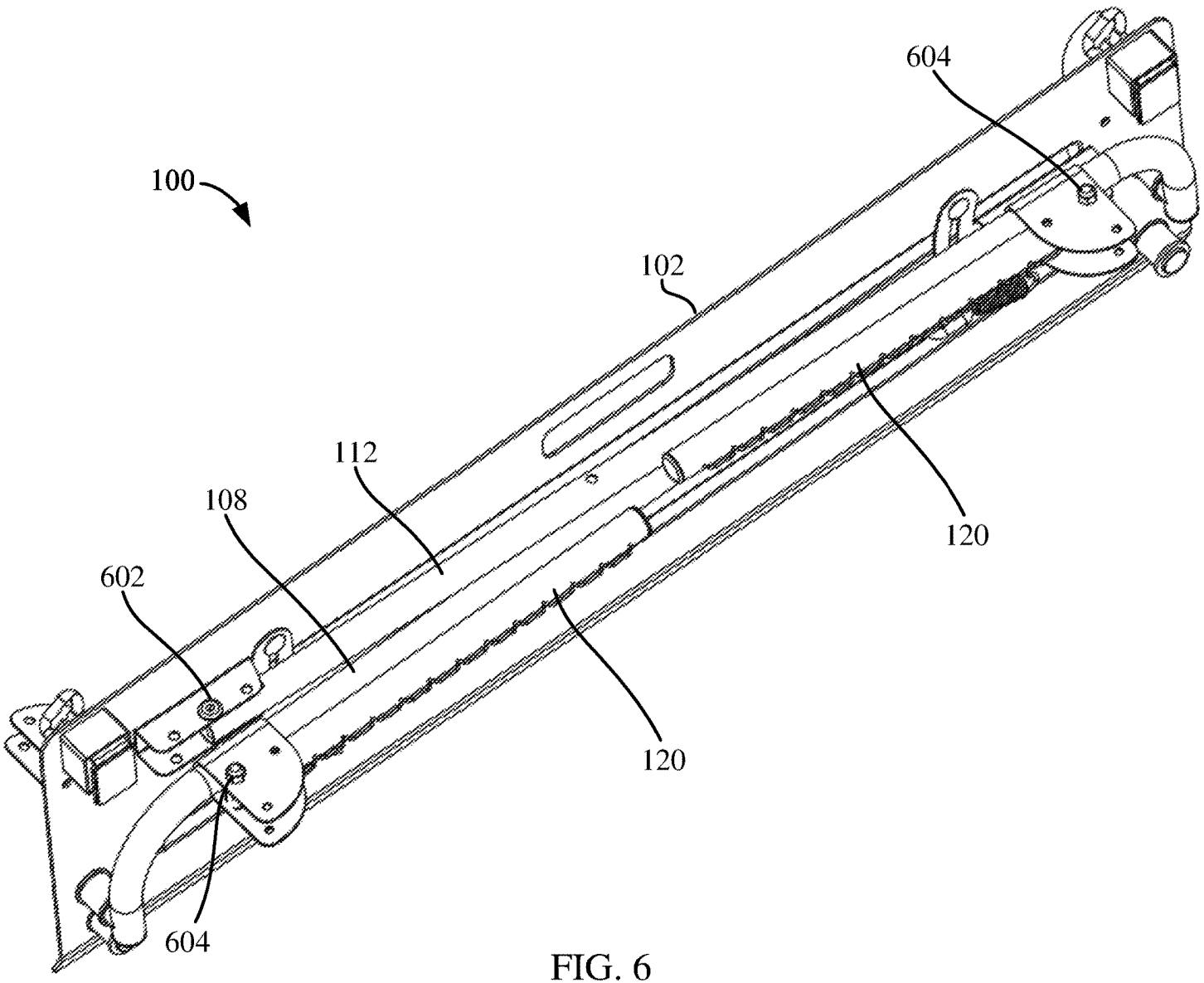
FIG. 6 is an isometric view of the bottom of the training device of FIG. 1 according to an embodiment showing rebounder wings folded up for storage and transport.

FIG. 6 is an isometric view showing the underside of the frame 102 from FIG. 1 showing the rebounder wings 104, 106 folded toward the underside of the frame 102. As shown, the first wing structure 108 and second wing structure 112 are coupled to the frame by respective hinged connections 602. As further shown, the backstop structures 120 coupled to the first and second wing structures 108, 112 are also coupled by a hinge to facilitate folding the backstop structures 120 as shown. In particular, each backstop structure 120 is coupled to the respective wing structure 108, 112 by a hinged connection 604.

Figure 7:
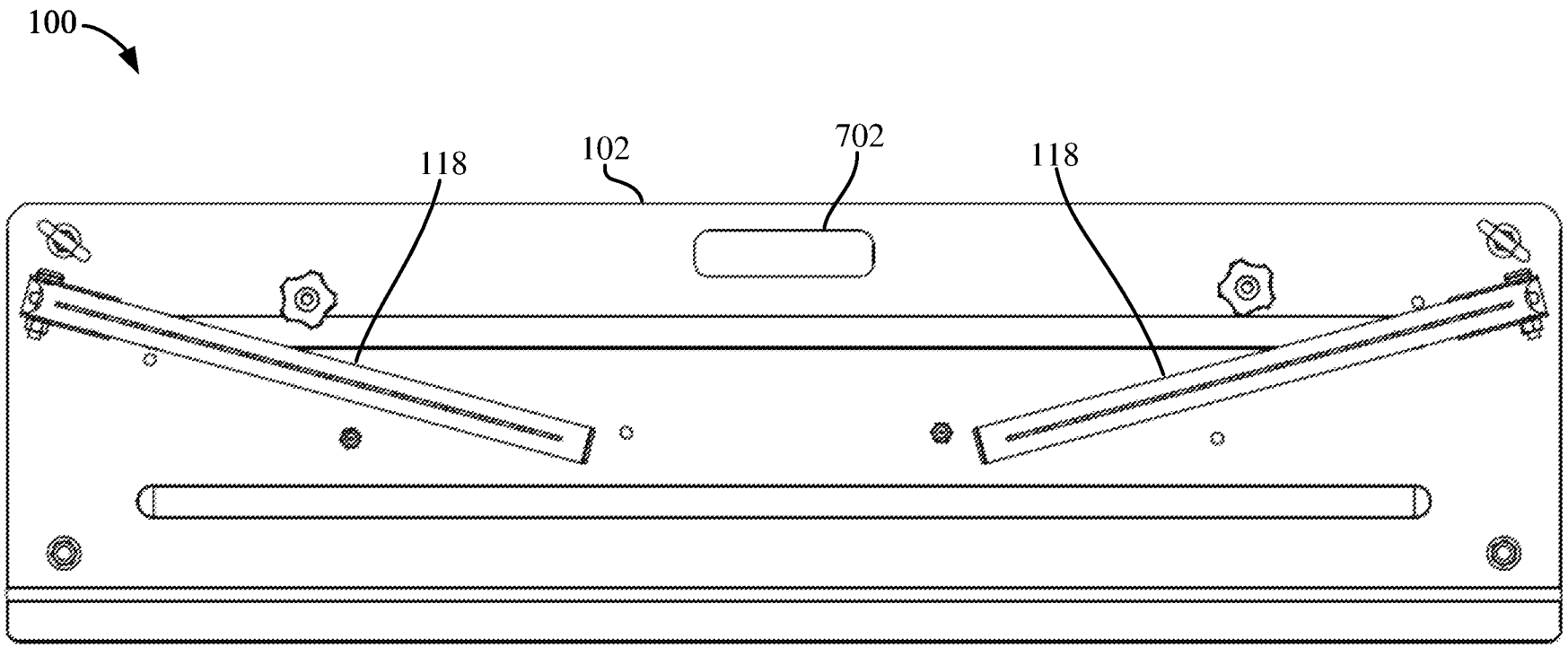
FIG. 7 is a top view of a rebounder folded up for storage and transport.

FIG. 7 is a top plan view of the training device 100 from FIG. 1 showing the backstop structures 118 folded down toward the topside of the frame 102. As shown, with the backstop structures 118 folded down toward the topside of the frame 102, and with any wing structures (when present) folded toward the underside of the frame 102, the training device 100 is readily portable. In some embodiments, the frame 102 may even include a handle 702 formed therein to further facilitate the portability of the training device 100.

While the above discussed aspects, arrangements, and embodiments are discussed with specific details and particularity, one or more of the components, steps, features and/or functions illustrated in FIGS. 1, 2, 3, 4, 5, 6, and/or 7 may be rearranged and/or combined into a single component, step, feature or function or embodied in several components, steps, or functions. Additional elements, components, steps, and/or functions may also be added or not utilized without departing from the present disclosure.

While features of the present disclosure may have been discussed relative to certain embodiments and figures, all embodiments of the present disclosure can include one or more of the advantageous features discussed herein. In other words, while one or more embodiments may have been discussed as having certain advantageous features, one or more of such features may also be used in accordance with any of the various embodiments discussed herein. In similar fashion, while exemplary embodiments may have been discussed herein as device, system, or method embodiments, it should be understood that such exemplary embodiments can be implemented in various devices, systems, and methods.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art. Thus, the scope of the disclosure is only determined by the literal language, and legal equivalents, of the claims which follow.

What is claimed is:

1. A hockey training device, comprising:

a frame including a top surface and an underside opposite from the top surface;

a plurality of pulleys coupled to the underside of the frame;

a first flexible band positioned on the underside of the frame and disposed around each pulley of the plurality of pulleys, wherein the first flexible band extends between the plurality of pulleys along a lateral side of the frame and is exposed to an outside of the frame along the lateral side of the frame;

a plurality of backstop structures coupled to the frame to extend substantially orthogonal to the top surface of the frame; and a net coupled to the plurality of backstop structures.

2. The hockey training device of claim 1, wherein the plurality of backstop structures are moveably coupled to the frame and are convertible between a folded position adjacent to the top surface of the frame and a position extending substantially orthogonal to a top surface of the frame.

3. The hockey training device of claim 1, further comprising a crossing structure coupled to the plurality of backstop structures and extending therebetween.

4. The hockey training device of claim 1, further comprising:

at least one spring coupled to at least one longitudinal end of the first flexible band.

5. The hockey training device of claim 4, further comprising:

a tensioner coupled to the at least one spring.

6. The hockey training device of claim 1, further comprising:

a first rebounder wing coupled to a first side of the frame, wherein the first rebounder wing includes a first wing structure coupled to the frame, and a second flexible band extending from a portion of the first wing structure to one of the frame or the first flexible band; and a second rebounder wing coupled to a second side of the rebounder, wherein the second rebounder wing includes a second wing structure coupled to the frame, and a third flexible band extending from a portion of the second wing structure to one of the frame or the first flexible band.

7. A hockey training device, comprising:

a frame including a top surface and an underside surface opposite from the top surface;

a plurality of pulleys coupled to the underside surface of the frame and extending away from the underside surface;

a first flexible band disposed around each pulley of the plurality of pulleys, wherein the first flexible band extends between the plurality of pulleys along a lateral side of the frame and is exposed to an outside of the frame along the lateral side of the frame;

a backstop coupled to the frame and including a plurality of backstop structures extending in a direction substantially orthogonal to the top surface of the frame; and a net coupled to, and extending between, the plurality of backstop structures.

* * * * *